US009077097B2

(12) United States Patent
Karodi et al.

(10) Patent No.: US 9,077,097 B2
(45) Date of Patent: Jul. 7, 2015

(54) MODULE CONNECTOR FOR UNINTERRUPTED COMMUNICATION

(71) Applicant: Honeywell International Inc., Morristown, NJ (US)

(72) Inventors: Milind Mohaniraj Karodi, Maharashtra (IN); Sunil Nagnathrao Kulkarni, Maharashtra (IN); Rahul Rameshrao Kulkarni, Maharashtra (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 25 days.

(21) Appl. No.: 13/943,201

(22) Filed: Jul. 16, 2013

(65) Prior Publication Data

US 2014/0038466 A1 Feb. 6, 2014

(30) Foreign Application Priority Data

Aug. 3, 2012 (IN) ..... 3194/CHE/2012

(51) Int. Cl.

| | |
|---|---|
| ***H01R 13/514*** | (2006.01) |
| ***H01R 9/26*** | (2006.01) |
| ***H01R 12/58*** | (2011.01) |
| ***H01R 13/703*** | (2006.01) |

(52) U.S. Cl.

CPC ..... *H01R 13/514* (2013.01); *H01R 9/2633* (2013.01); *H01R 12/58* (2013.01); *H01R 13/7034* (2013.01)

(58) Field of Classification Search

USPC ..... 439/81, 108, 489, 681, 633, 267

See application file for complete search history.

(56) References Cited

U.S. PATENT DOCUMENTS

| | | | | |
|---|---|---|---|---|
| 4,159,861 | A * | 7/1979 | Anhalt | 439/267 |
| 4,862,400 | A * | 8/1989 | Selbrede | 361/752 |
| 5,160,273 | A * | 11/1992 | Carney | 439/108 |
| 5,716,227 | A * | 2/1998 | Detter | 439/353 |
| 6,159,052 | A * | 12/2000 | Meng et al. | 439/633 |
| 7,758,368 | B2 * | 7/2010 | Schelonka et al. | 439/325 |
| 7,789,698 | B2 * | 9/2010 | Hashimoto et al. | 439/495 |
| 2008/0106266 | A1 * | 5/2008 | Diessel | 324/415 |

FOREIGN PATENT DOCUMENTS

EP 0 616 397 A2 9/1994

OTHER PUBLICATIONS

European Search Report, dated Oct. 24, 2013, corresponding to Application No. EP 13 17 8736.

* cited by examiner

*Primary Examiner* — Alexander Gilman

(74) *Attorney, Agent, or Firm* — Husch Blackwell LLP

(57) ABSTRACT

A module connector (102) for uninterrupted communication is described. The module connector (102) comprises a slot (602) for receiving connector pins (702) of an I/O module 500. The slot (602) has at least one pair of mating pins (606) to connect with the connector pins (702) of the I/O module (500). The at least one pair of mating pins (606) is normally closed in absence of the connector pins (702) in the slot (602). Further, the at least one pair of mating pins (606) in a normally closed state moves to an open state upon receiving the connector pins (702) of the I/O module (500) in the slot (602).

11 Claims, 9 Drawing Sheets

MODULE CONNECTOR FOR UNINTERRUPTED COMMUNICATION

TECHNICAL FIELD

The present subject matter, in general, relates to circuit based systems, and in particular, relates to a module connector for circuit based systems.

BACKGROUND

A variety of input-output (I/O) modules may be used as building blocks in circuit based systems, such as sensor assemblies or computing systems. For example, in systems managing control or measurement operations, sensor assemblies are implemented for various purposes, such as temperature control, gas detection, and fire detection. The I/O modules may be configured to perform desired control actions as per user requirements. The I/O modules may process data received from sensors or detectors installed at field sites and transmit the processed data to a central control board (CCB) for the required control action to be implemented.

In one example, the various I/O modules in a sensor assembly are connected to a circuit board that provides for connection between the I/O modules and the CCB. The I/O modules may be connected to the circuit board through module connectors placed on the circuit board. The module connectors serve as sockets into which the I/O modules may be inserted or removed as per the requirement.

The assembly formed by the I/O modules mounted on the circuit board through module connectors, may be further mounted onto a supporting structure for various purposes, such as mounting the assembly in a desired location.

In one example, the assembly may be mounted onto a Deutsches Institut für Normung (DIN) rail. The DIN rail is a standard type metallic rail or track widely used for mounting the I/O modules for various control operation in industries. A user can, for example, attach the circuit board with the module connectors to the DIN rail and mount the I/O modules onto the DIN rail by simply plugging the I/O modules in the module connectors or even remove the I/O modules from the DIN rail by unplugging the I/O modules from the module connectors.

Consider an example where a user requires gas detection control or measurement operation in an industrial building. In such a case, the user may mount one or more I/O modules for gas detection control or measurement operation, onto a DIN rail through module connectors. The I/O modules may receive field data from one or more gas sensor for processing. The processed data may be further transmitted to the CCB, through the module connectors and the circuit board, for the further data processing or for performing some control action, such as generating an alarm or opening of exhaust vents.

An I/O module mounted onto the circuit board through the module connector may be removed in case the I/O module is no longer needed. For example, the I/O module may be removed and may be replaced by another I/O module. In one example, an existing I/O module may be replaced with another I/O module having an updated version of software in a processor of the I/O module. In another example, any one of the several I/O modules present in a sensor assembly may become malfunctional and may be removed for repair or for replacement by another I/O module.

SUMMARY

This summary is provided to introduce concepts related to a module connector, which is further described below in the detailed description. This summary is not intended to identify essential features of the claimed subject matter nor is it intended for use in determining or limiting the scope of the claimed subject matter.

In accordance with an embodiment of the present subject matter, a module connector for uninterrupted communication is described. The module connector comprises a slot for receiving connector pins of an I/O module. At least one pair of mating pins is disposed in the slot. The at least one pair of mating pins is normally closed in absence of the connector pins in the slot. Further, the at least one pair of mating pins in a normally closed state moves to an open state upon receiving the connector pins of the I/O module in the slot.

BRIEF DESCRIPTION OF THE DRAWINGS

The detailed description is described with reference to the accompanying figure(s). In the figure(s), the left-most digit(s) of a reference number identifies the figure in which the reference number first appears. The use of the same reference number in different figure(s) indicates similar or identical items. The features, aspects and advantages of the subject matter will be better understood with regard to the following description, and the accompanying drawings.

FIG. 7(*b*) illustrates a side view of the module connector in a normally closed state, in accordance with an embodiment of the present subject matter.

Figure 1:
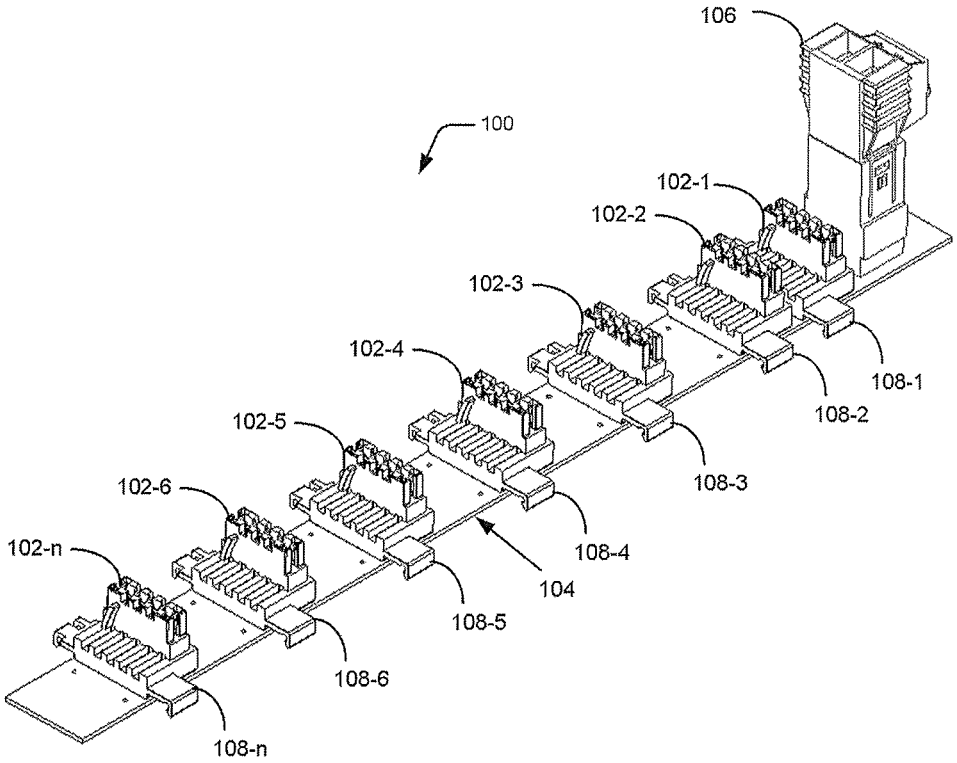
FIG. 1 illustrates a perspective top view of a backplane assembly with a plurality of module connectors, in accordance with an embodiment of the present subject matter.

It should be appreciated by those skilled in the art that any block diagrams herein represent conceptual views of illustrative systems embodying the principles of the present subject matter.

DESCRIPTION OF EMBODIMENTS

For building circuit based systems, for example, sensor assemblies, usually one or more module connectors are attached to a circuit board to form a backplane assembly. The module connectors may be understood as socket like structures attached to the circuit board and I/O modules, configured to perform various control or measurement related operations, may be inserted into the module connectors. The I/O modules comprise processors that process data required for performing the control or measurement operations for which the circuit based system is implemented. For example, an I/O module in a sensor assembly configured for fire detection may receive data, such as temperature and level of carbon dioxide from respective field sensors and process the data to generate a control signal. The control signal may in turn indicate to a central control board (CCB) of the sensor assembly that a control operation, such as the activation of water sprinklers is required to be performed. Thus, the I/O modules comprise the intelligence for the data processing while the backplane assembly provides for communication between various components of the sensor assemblies. For instance, in the present example, the backplane assembly serves a means for communication of data and signals between the field sensors, the I/O modules and the CCB. Additionally, the backplane assembly also allows distribution of power distribution from a power supply to the I/O Modules, sensors and field devices.

In making the backplane assembly, the one or more module connectors are connected to the circuit board through a plurality of connecting pins. The plurality of connecting pins is provided in a predefined pattern on a bottom surface of a module connector. For example, the connecting pins may be provided in two rows on the bottom surface of the module connector. The connecting pins of a module connector may be configured to act as input or output pins for communication of data and signal for an I/O module coupled to that module connector. The I/O modules may receive data, such as data from the field sensors and detectors, through the connecting pins provided in one row of the module connector. The I/O module may process the received data, and transmit the processed data to another I/O module or the CCB through the connecting pins provided in other row of the module connector.

The backplane assembly formed by the module connectors and the circuit board may often need a supporting structure, for example, to mount or affix the backplane assembly in an appropriate location. In one example, the backplane assembly may be mounted onto a DIN rail. The DIN rail is a metallic rail or track used to mount various I/O modules in accordance with the DIN standard. DIN is a worldwide standard for dimensional uniformity for products regardless of the manufacturer.

Typically, once the backplane assembly is attached to the DIN rail and is mounted in the desired location, the I/O modules are plugged-in into the module connectors. Generally, I/O modules are mounted onto the DIN rail through the module connectors in series for performing the control and measurement operations. The I/O modules may communicate processed data received from the field sensors to the CCB through a ring communication protocol. Quite often in a circuit based system, the I/O modules are not plugged in each of the module connectors. In such cases, the communication of the signals or power supply distribution from one I/O module to the other I/O module and I/O modules to the CCB may get interrupted because of communication link failure.

In one conventional approach, dummy I/O modules may be used to avoid breaking of the communication link. Use of the dummy I/O modules to avoid breaking of the communication link often proves costly, more so in cases where a large number of module connectors of the circuit board are without the I/O modules. For example, consider a sensor assembly where a circuit board placed on a DIN rail includes five module connectors. If the design of sensor assembly dictates employing only a single I/O module in this case, four dummy I/O modules will be required for completing the communication link or to avoid breaking of the communication link. Therefore, the use of four dummy devices may increase the cost of the sensor assembly in terms of procurement of the components as well as the cost of operation of the sensor assembly for performing the control and measurement operation.

Further, the conventional circuit based systems may not be capable of supporting hot insertion and hot removal of the I/O modules due to ring communication protocol. Hot insertion, in this context may be understood as insertion of an I/O module onto a module connector of the backplane assembly when power supply and data communication within the IO modules and CCB is in an 'ON' state, without disturbing other I/O modules or the communication of signals and data that may be ongoing between the I/O modules and the CCB. Similarly, hot removal, refers to removal of an I/O module from a module connector of the backplane assembly when the power supply and the data communication is in an 'ON" state of the assembly without disturbing the other I/O modules or the communication of signals and data that may be ongoing between the I/O modules and the CCB. In other words, hot insertion/removal is addition/disengagement of the I/O modules in the power 'ON' state of the assembly without affecting the ring communication of the signals and data. Although, hot insertion and removal is desired in many instances, the existing architecture of the module connector fails to provide for the same. For instance, in case of hot removal, the ring communication of data gets affected due to removal of the I/O modules from the module connector or the removal of dummy I/O modules which are plugged-in the module connector to complete the communication link. The communication link between the other I/O modules and the CCB responsible for the ring communication may break because of the removal of the I/O module or the dummy IO module, as the case may be, from the module connector.

The present subject matter describes a module connector for an uninterrupted communication. The module connector provides uninterrupted communication between the I/O modules and the CCB in a circuit based system and is independent of the presence of an I/O module for completing the communication link. The module connector ensures that the other I/O modules or the communication of signals and data or power supply distribution that may be ongoing between the I/O modules and the CCB remain unaffected whenever hot insertion or removal of an I/O module coupled to the module connector are performed.

In one embodiment, at least one pair of mating pins is disposed in the module connector within a slot where an I/O module is inserted onto the module connector. In other words, the mating pins are disposed in the slot of the module connector that receives connector pins of the I/O module to couple the I/O module to the module connector and in turn to the circuit board.

In one implementation, each pair of mating pins is a normally closed pin, i.e., opposite mating pins of the pair of mating pins are normally closed to complete a communication link through the module connector. To enable uninterrupted communication to take place, for instance, when no I/O module is plugged-in into the module connector, the opposite mating pins in the slot of the module connector remain in a normally closed state, shorted to each other, and complete the communication link. When the I/O module is inserted into the module connector, the opposite mating pins of the pair of mating pins separate and move to an open state to accommodate connector pins of the I/O module. Thus, in case the I/O module is coupled to the module connector, the communication link may be established through the I/O module while in case of absence of the I/O module, the mating pins, in a closed position, complete the communication link between the I/O modules and the CCB, or the I/O module and other I/O modules as the case may be. Therefore, the module connector allows an uninterrupted communication between the I/O modules and the CCB, and between different I/O modules.

In case of hot removal of the I/O module, when the I/O module is removed and the connector pins of the I/O module are withdrawn from the slot of the module connector, the at least one pair of mating pins in the open state move back to the normally closed state ensuring that the communication link between the I/O modules and the CCB and between different I/O modules remains completed.

Further, in one embodiment, the module connector includes a guiding rib on a side surface of the module connector. The guiding rib may allow proper alignment of the I/O modules on the module connector. The guiding rib may help in ensuring safety of the I/O module by ensuring that a ground connection is secured first before connection to a power supply.

These and other advantages of the present subject matter would be described in a greater detail in conjunction with the following figures. It should be noted that the description and figures merely illustrate the principles of the present subject matter.

The specification provided here explains in a detailed manner the module connector for an uninterrupted communication in circuit based assemblies. For the ease of understanding, the module connector has been explained herein in context of an assembly of backplane PCB having multiple module connectors soldered to it and affixed to a DIN rail. However, it will be appreciated by one skilled in the art, that although the module connector has been described with respect to an assembly of backplane PCB, multiple module connectors, and a DIN rail, the concept explained in context thereto may be extended to any other circuit board to which the module connector may be connected, and any other metallic rail or hard circuit on which the module connectors may be mounted, without deviating from the scope and spirit of the invention. For example, the module connector may be soldered to a stripboard which is in turn mounted onto a metal sheet.

FIG. 1 illustrates a perspective top view of a backplane assembly 100, in accordance with an embodiment of the present subject matter. FIG. 1 shows multiple module connectors 102-1, 102-2 . . . **102-*n*, hereinafter collectively referred to as the module connectors 102 and individually referred to as a module connector 102. The number of module connectors 102 included in a backplane assembly 100 is determined by the design of a circuit based system (not shown in Figures) in which the backplane assembly 100** will be implemented and may vary accordingly.

The backplane assembly 100 may be implemented in various circuit based systems or computing systems, hereinafter interchangeably referred to as systems. The examples of such systems include, but is not limited to, data acquisition systems, industrial control system, programmable logic controllers, building automation and control systems, distributed control systems and supervisory control and data acquisition (SCADA) systems. It should be appreciated that it is for ease of understanding that the present description is provided in context of a circuit based system. The same should not be construed as a limitation since the concepts explained in context of such systems may be extended to various other systems, such as computing systems that include backplane assemblies having module connectors 102.

The module connectors 102 are connected to a circuit board 104. In one example, the module connectors 102 may be connected to a circuit board 104, such as a printed circuit board (PCB), a stripboard or any other equivalent structure that may provide an electrical coupling between the various module connectors 102 placed on the circuit board 104. The module connectors 102 may be connected to the circuit board 104 through various methods, such as soldering and riveting. The module connectors 102 upon being connected to the circuit board 104 forms the backplane assembly 100.

In one embodiment, the backplane assembly 100 may also have a power supply socket 106 connected to the circuit board 104. The power supply socket 106 may provide power supply to the backplane assembly 100 from a power supply source. The power supply, again, is based on the design of the system. In one implementation, a power supply of 24 V dc and 3 A may be provided to the module connectors 102 connected to the circuit board 104.

Each of the module connectors 102-1, 102-2 . . . **102-*n*, in one embodiment, may also be provided with a pair of arm like protruding structures, known as modular snaps 108-1, 108-2 . . . 108-*n*, respectively. The modular snaps 108-1, 108-2 . . . 108-*n*, collectively, referred to as modular snaps 108, are used to affix the backplane assembly 100** to a supporting structure.

Each of the module connectors 102 may have at least one pair of contact pins (not shown in FIG. 1) disposed within the module connectors 102. The contact pins, in one example, are in a normally closed state. Both the contact pins in the pair of contact pins remain shorted to each other in the absence of an electronic device in the module connector 102. This allows an uninterrupted communication of signals or uninterrupted power supply distribution in the backplane assembly 100 through the pair of contact pins even in the absence of the electronic device. Details of the contact pins of the module connectors 102 have been elaborated later in the present description.

Figure 2:
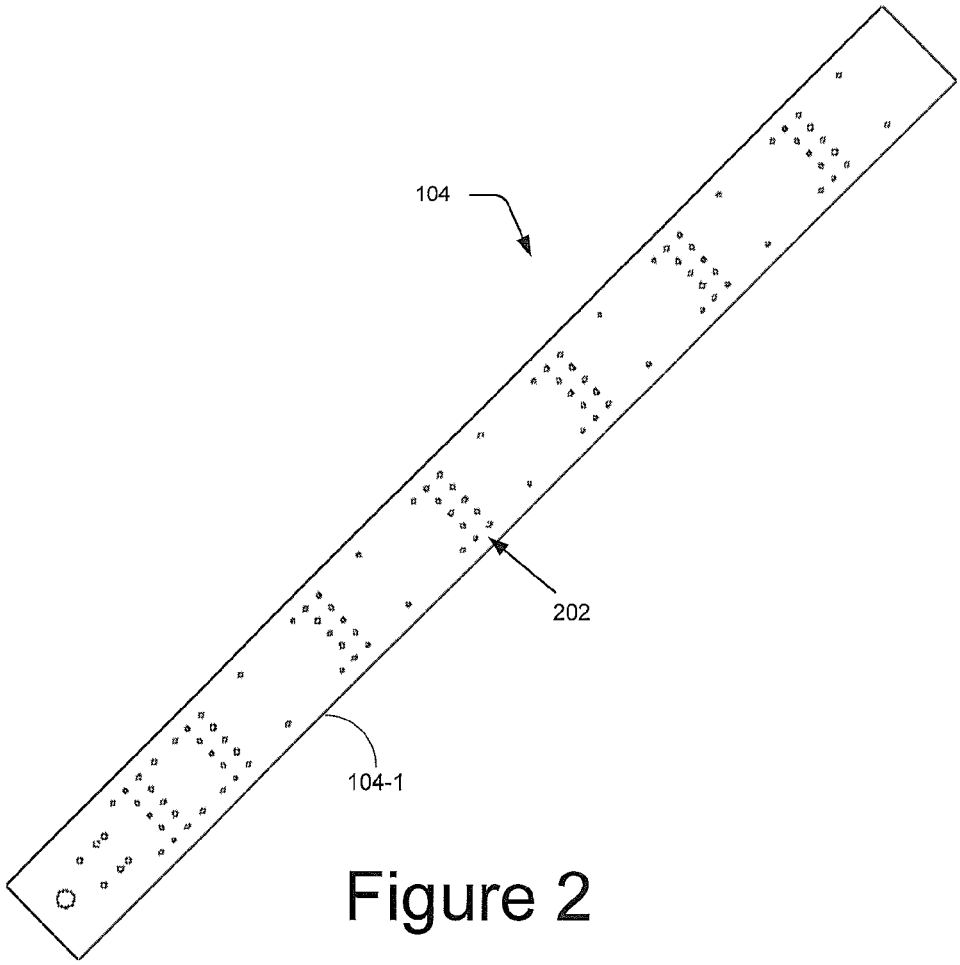
FIG. 2 illustrates a top view of a circuit board, in accordance with an embodiment of the present subject matter.

FIG. 2 illustrates a top view of the circuit board 104, in accordance with an embodiment of the present subject matter. In the example illustrated in FIG. 2, the circuit board 104 is a PCB 104-1. The PCB 104-1 has a plurality of plated through-holes 202 for connecting various electronic components, such as the module connectors 102. In order to accommodate the electronic components on the PCB 104-1, the plurality of plated through-holes 202 are provided in a particular arrangement depending design of the assembly. Also, each electronic component comprises a number of connecting pins through which the electrical component may be connected to the PCB 104-1. The number of plated through-holes 202 provided in the PCB 104-1 is in accordance with number of connecting pins in the electronic components that is to be connected. To explain this, the example depicted in FIG. 1, where module connectors 102 are soldered to a PCB 104-1 may be referred once again. Each of the module connectors 102, in the present example, may comprise five connecting pins (not shown in FIG. 2) placed in two rows. Accordingly, it can be seen from FIG. 2 that the plurality of plated through-holes 202 in the PCB 102-1 are provided in sets of two rows of five plated through-holes 202 each to allow soldering of a module connector 102 to the PCB 104-1. The two rows of pins may be referred to as the input pins and the output pins since electrical signal enter in to the module connector 102 through the input pins and exit through the output pins.

Once the modules connectors 102 are connected to the circuit board 104 as per the design of the system, the backplane assembly 100, as explained previously, is formed. The circuit board 104 comprises in-built electrical connections that provide a communication link between one or more module connectors 102 in accordance with the design of the system. Also, usually, connections from the power supply socket 106 to each of the module connector 102 are also provided.

In one embodiment, the backplane assembly 100 may be affixed to a supporting structure. The supporting structure imparts strength to the backplane assembly 100 and often serves as a means to mount the backplane assembly 100 on desired location, for example, onto a wall-like structure. Examples of supporting structure include, but are not limited to, a DIN rail or any other wooden, metallic or plastic panels on to which the backplane assembly 100 may be affixed. For example, in one implementation, the backplane assembly 100 may be mounted on a supporting structure, such as a metal sheet and cardboard.

Figure 3A:
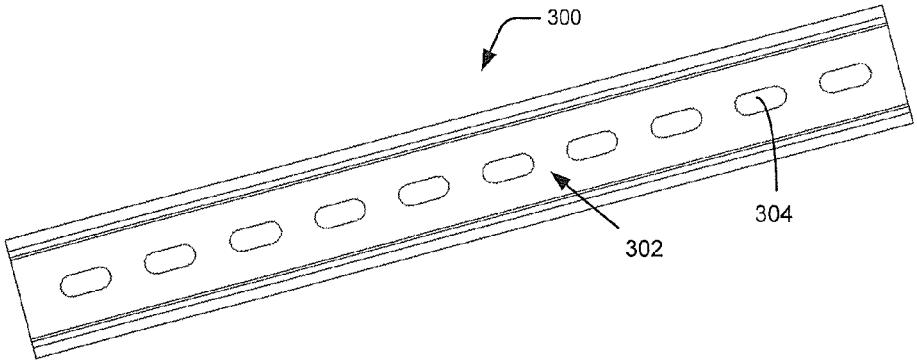
FIGS. 3(*a*) and 3(*b*) illustrate a top view and a perspective top view of a DIN rail respectively, in accordance with an embodiment of the present subject matter.
Figure 3B:
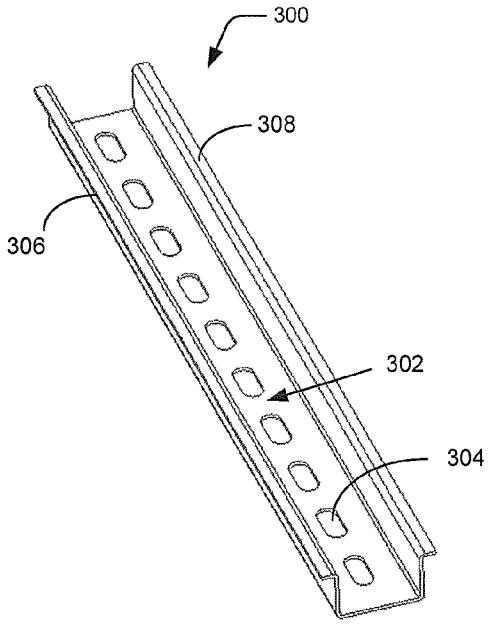

FIGS. 3(*a*) and 3(*b*) illustrate a top view and a perspective top view of a DIN rail 300 respectively, in accordance with an embodiment of the present subject matter. The DIN rail 300 is a standardized metallic rail, to which an electrical panel, such as the backplane assembly 100 may be mounted. The DIN rail 300 may be of different types. For example, the DIN rail 300 as show in the FIGS. 3(*a*) and 3(*b*) is a top-hat type rail. The depicted DIN rail 300 is referred so because of its hat-shaped cross section. In other examples, other types of DIN rails, such as a 'C' Type or a 'G' type DIN rail may be used for mounting the backplane assembly 100.

Further, the DIN rail 300 has an accommodating surface 302 to accommodate the electrical panel, such as the backplane assembly 100, onto the DIN rail 300. The accommodating surface 302 has mounting holes 304 to provide a medium for fixing the DIN rail 300 on to a wall or an equipment rack. The DIN rail 300 has a first flange 306 and a second flange 308 on either side of the accommodating surface 302 for providing support to the backplane assembly 100 mounted onto the DIN rail 300. In one implementation, the DIN rail 300 of different width may be used depending upon requirements of an assembly. For example, a DIN rail 300 having a width of 35 mm may be used for mounting the backplane assembly 100.

Figure 4:
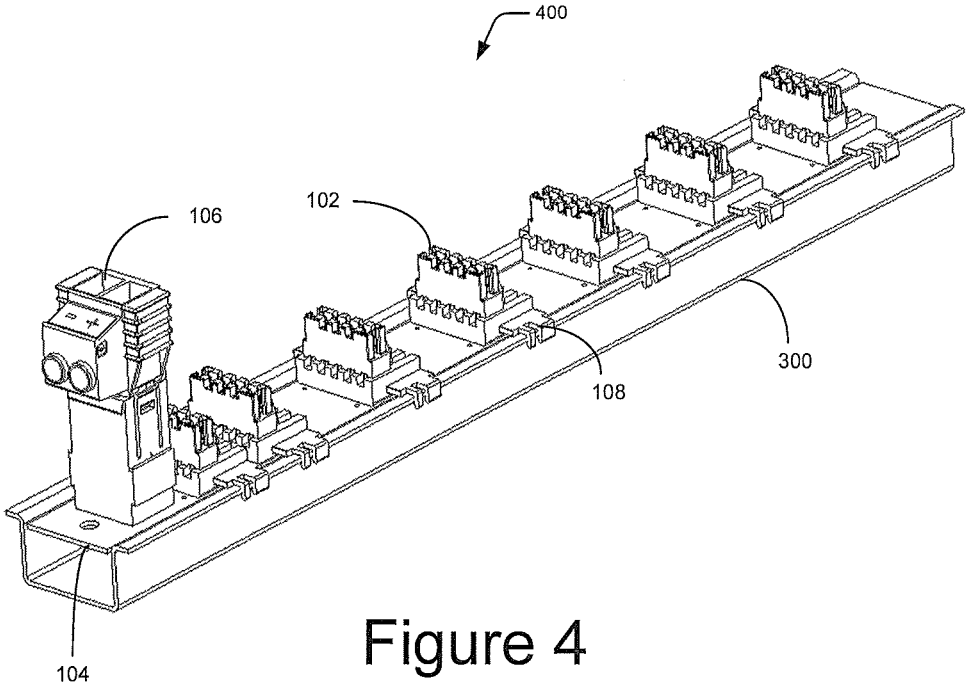
FIG. 4 illustrates a perspective top view of a supported assembly with the backplane assembly affixed to the DIN rail, in accordance with an embodiment of the present subject matter.

FIG. 4 illustrates a perspective top view of a supported assembly 400 with the backplane assembly 100 affixed to the DIN rail 300, in accordance with an embodiment of the present subject matter. FIG. 4 shows the DIN rail 300, on which the backplane assembly 100 is accommodated by methods, such as by press fitting. The modular snaps 108 of the module connectors 102 latches to the first flange 306 and the second flange 308 of the DIN rail 300 upon press fitting and rigidly connects the backplane assembly 100 to the DIN rail 300. The supported assembly 400 may now be mounted on wall or an equipment rack.

Once the supported assembly 400 is mounted at a desired location, other components of the system may be plugged into the module connectors 102. It is also possible that the components may be first plugged in and thereafter the supported assembly 400, along with the plugged-in components, be mounted at the desired location.

Figure 5A:
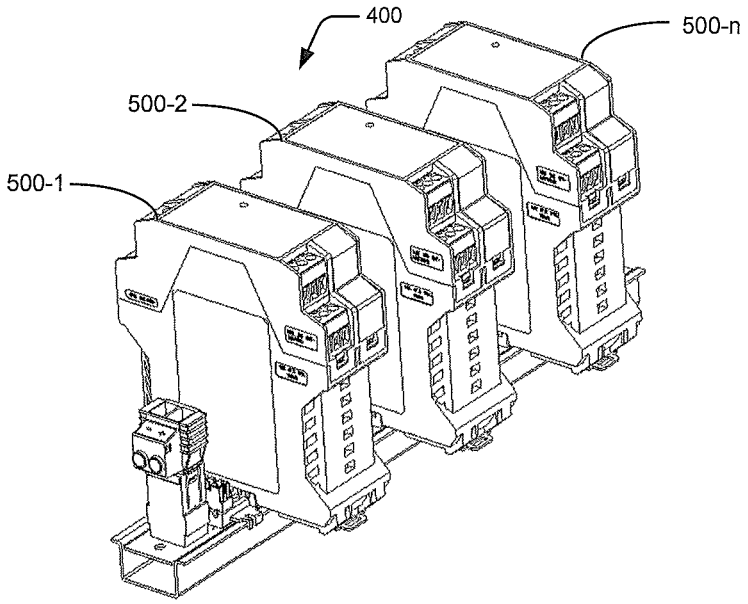
FIGS. 5(*a*) and 5(*b*) illustrate perspective top views of the supported assembly with I/O modules, in accordance with an embodiment of the present subject matter.
Figure 5B:
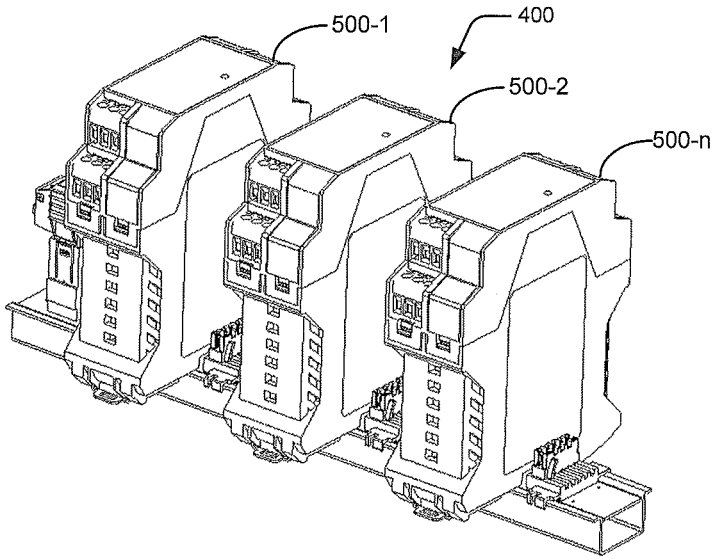
Figure 6A:
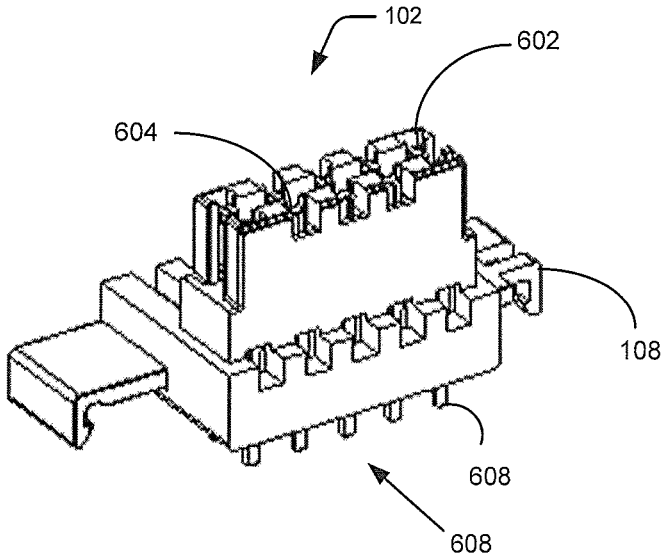
FIGS. 6(*a*) to 6(*d*) illustrate a module connector respectively, in accordance with an embodiment of the present subject matter.
Figure 6B:
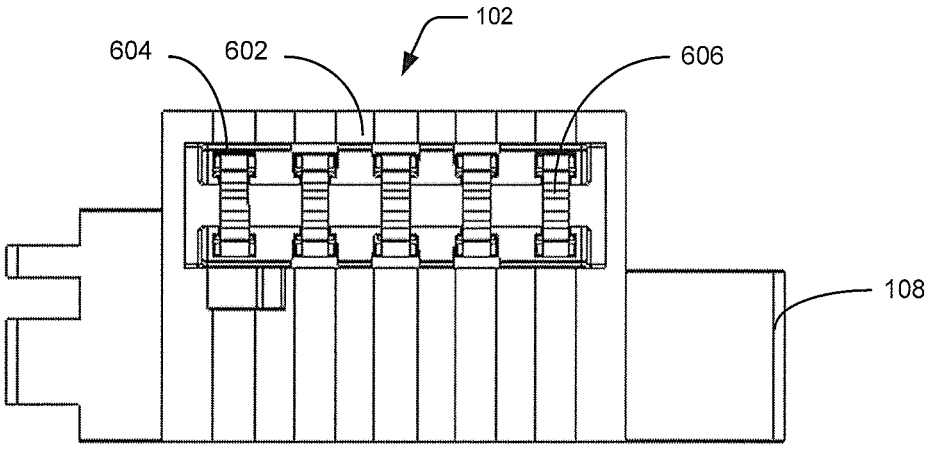
Figure 6C:
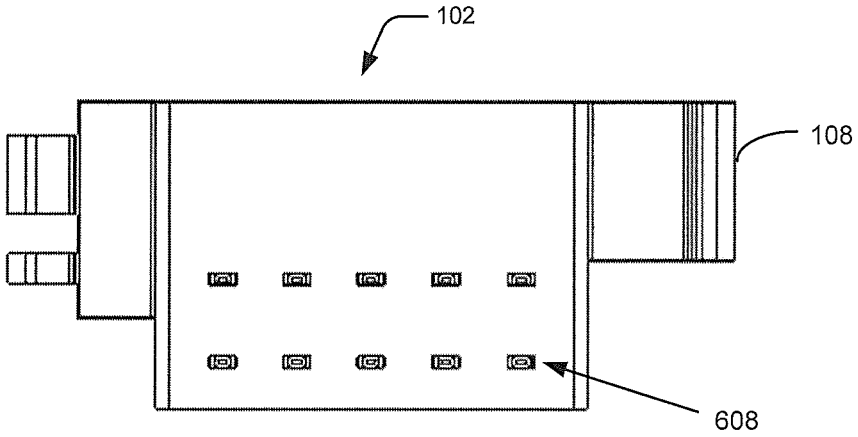
Figure 6D:
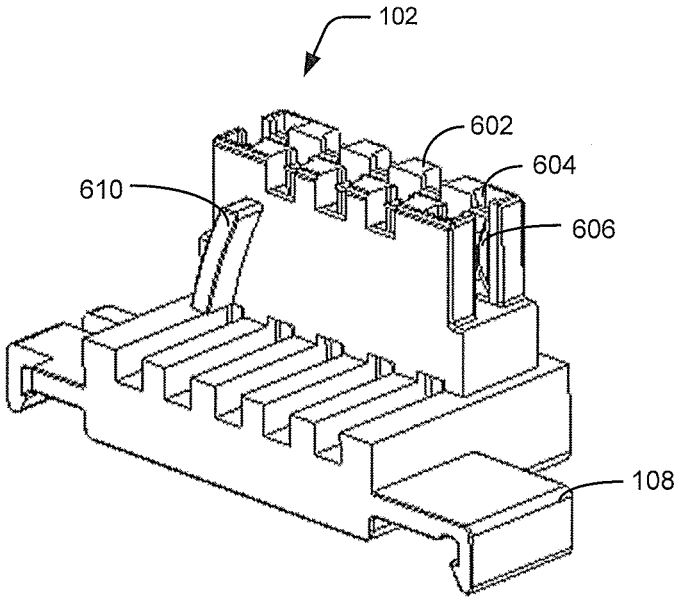

FIGS. 5(*a*) and 5(*b*) illustrate perspective top views of the supported assembly 400 with components, such as I/O modules 500-1, 500-2 . . . **500-*n*, collectively referred to as I/O modules 500, connected to the module connectors 102, in accordance with an embodiment of the present subject matter. The I/O modules 500 may be understood as a processing device, which receives the data/signals for processing and outputs the processed data/signals. The I/O module 500 may include a microprocessor to process the data/signals received. In one example, in the sensor assembly, the I/O modules 500** may be configured to receive field data from sensors and process that same such that appropriate control operation may be enabled. The control operation is not restricted to generating an alarm or opening of exhaust vents. For example, control operation may also include indicating information and monitoring. It will be appreciated by one skilled in the art that the examples are included merely for easy of understanding and should not be construed as limitations.

Thus, the module connectors 102 serve as sockets onto which the I/O modules 500 are plugged in and the circuit board 104 serves as a means for electrical communication between the I/O modules 500 and the CCB that enables the control operation.

To complete the communication link, electrical signals travel through the electrical connections provided on the circuit board 104, into an I/O module 500, for example I/O module 500-1 via the inputs pins of the module connector 102-1 and exit through the output pins of the module connector 102-1. The electrical signals then, based on the electrical connections provided on the circuit board 104, may then enter I/O module 500-2 and exit there from to the next I/O module **500-*n***.

Some of the module connectors 102, as depicted in FIGS. 5(*a*) and 5(*b*), are without the I/O module 500. In a conventional arrangement, as explained earlier, absence of an I/O module 500 from a module connector 102 leads to communication link failure since the path of the electrical signals fails to be completed. However, in accordance with the present subject matter, module connectors 102 are configured to complete the communication link without the I/O module 500. The subsequent description, elaborates the construction and working of a module connector 102 such that it may be understood how the module connector 102 enables the completion the communication link without the I/O module 500.

FIGS. 6(*a*) to 6(*d*) illustrate a module connector 102 respectively, in accordance with an embodiment of the present subject matter.

FIG. 6(*a*) shows a perspective side view of the module connector 102. As illustrated, the module connector 102 has a slot 602, which allows plugging of the I/O modules 500 onto the backplane assembly 100. In one embodiment, the slot 602 is carved to obtain multiple grooves 604. As shown in the FIG. 6(*b*), a pair of mating pins 606 is disposed in each of the grooves 604. In one implementation, at least one pair of mating pins 606 is present in at least one of the multiple grooves 604. The mating pins 606 are the contact pins, explained in context of FIG. 1 previously. As seen from FIG. 6(*b*), the opposite pins in a pair of mating pins 606, placed in a groove 604, face each other. The pairs of the mating pins 606 are normally closed pins. In absence of the I/O module 500, the pair of mating pins 606 may remain in a normally closed state such that the opposite pins of a pair of mating pins 606 are in contact with each other such that an electrical signal may flow through them. The example illustrated in FIG. 6(*b*) shows five pair of mating pins 606 in the slot 602. In one implementation, two pair of mating pins 606 may act as data pins, two pair of mating pins 606 may act as power pins, and one pair of mating pins 606 may be kept as spare pins.

In one implementation, mating pins 606 may be plated with metals or alloys depending upon operating conditions of the system. For example, mating pins 606 may be made of various materials that are electrically conductive and possess elasticity. The examples of such material include, but are not limited to, Phosphor bronze or Beryllium copper. In one implementation, the mating pins 606 may be plated with materials, such as conductive materials, material that withstand high temperature or materials that are corrosion resistant. Some examples of such plating include, but are not limited to, a selective Gold plating with a Nickel undercoat that have operating temperature substantially ranging from −40 to 85 Degree Celsius and are corrosion resistant. In other implementations based on the operating conditions of the system, the mating pins 606 may be coated with Silver plating or Tin plating or Tin-Nickel plating. It will be appreciated by one skilled in the art that the choice of material of the mating pins 606 or the material for plating the mating pins 606 is based on various considerations, such as the range of operating temperature, number of insertion and removal cycles of the I/O module 500, other operating conditions, and cost of the system.

Further, a plurality of solder pins 608 is provided on a bottom surface of the module connector 102. The plurality of solder pins 608 is used to solder the module connector 102 to the circuit board 104. FIG. 6(*c*) illustrates a bottom view of the module connector 102, in accordance with an embodiment of the present subject matter. FIG. 6(*c*) shows the plurality of solder pins 608. The solder pins 608 are connecting pins as explained in context of FIG. 2 previously. In one example, five solder pins each, in two rows, are provided in accordance with the plated through holes 202 in the circuit board 104. The pins in each of the two rows, also referred to as input and output pins, are inserted in to the plated through holes 202 in the circuit board 104 and soldered there upon to connect the module connector 102 to the circuit board 104. In the present description solder pins 608 are used only as an example for the purposes of illustration. It will be evident to a person skilled in the art that various other types of connecting pins, such as wire wrapped pins may be used in place of solder pins 608 to connect the module connector 102 to the circuit board 104.

In one implementation, the solder pins 608 are made of conductive material of various types, such as alloys of copper and may be coated with various materials to enhance solderability and conductivity. For example, the solder pins 608 may have Copper plating or Phosphor bronze plating or selective Gold plating with a Nickel undercoat to have better soldering capability. As will be appreciated by one skilled in the art, the choice of material of the solder pins 608 or the material for plating the solder pins 608 is based on various considerations, such as the range of operating temperature of the system.

FIG. 6(*d*) illustrates another perspective side view of the module connector 102, in accordance with an embodiment of the present subject matter. FIG. 6(*d*) shows a guiding rib 610 on a side surface of the module connector 102. The guiding rib 610 assists in plugging the I/O module 500 onto the module connector 102 which is further connected to the backplane assembly 100. The I/O module 500 may be plugged in a tilted manner, to first fit in the guiding rib 610. This ensures proper placement of the I/O module 500 in the module connector 102. Also, the guiding rib 610 may help in ensuring safety of the I/O module 500 by ensuring that a ground connection is secured first before connection to a power supply.

Figure 7A:
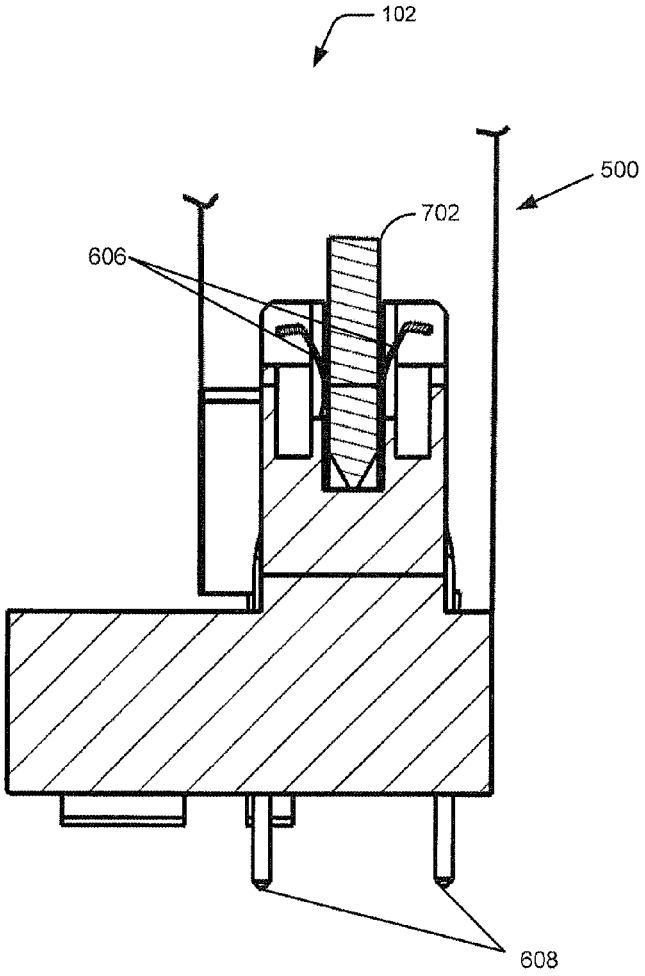
FIG. 7(*a*) illustrates a side view of the module connector in an open state, in accordance with an embodiment of the present subject matter.
Figure 7B:
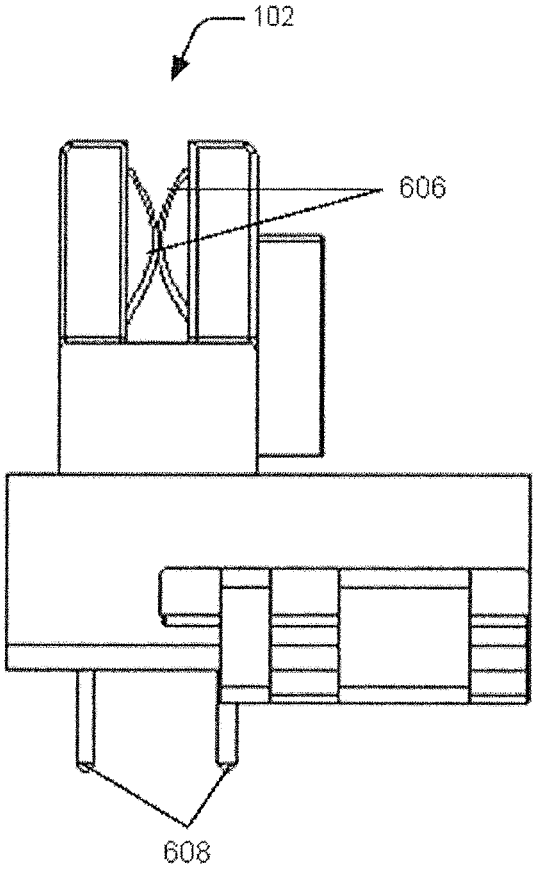

FIG. 7(*a*) illustrates a side view of a module connector 102 with the mating pins 606 in an open state, in accordance with an embodiment of the present subject matter. FIG. 7(*a*) shows a connector pin 702 of an I/O module 500 inside the slot 602 of the module connector 102. The connector pin 702 may be, for example, a metallic connector, a PCB based connector, such as a circuit board foot print or an edge connector. As seen from FIG. 7(*a*), the connector pin 702, upon its insertion into the slot 602 moves the mating pins 606 from a normally closed state to the open state. In the open state, the communication of signals and data or distribution of power supply takes place through I/O module 500. The communication signals enter the module connector 102 through the solder pin 608 which is configured to act as an input pin. The connector pin 702 of the I/O module 500 receives the signals from a mating pin 606 in the module connector 102 for processing the same. The processed signals are transmitted to the solder pin 608 which is configured to act as an output pin, through an opposite mating pin 606 in the module connector 102. The processed signal may be then transmitted to other I/O modules 500 or to CCB through the output pin.

FIG. 7(*b*) illustrates a side view of the module connector in the normally closed state, in accordance with an embodiment of the present subject matter. FIG. 7(*b*) shows the module connector 102 without the I/O module 500. When the connector pin 702 is taken out of the slot 602 of the module connector 102, the mating pins 606 get back to the normally closed state. In the normally closed state, the communication link establishes through the mating pins 606 and an uninterrupted communication is achieved. In the normally closed state also, the communication signals enter the module connector 102 through the solder pin 608 acting as an input pin. The signals are further passed on to a mating pin in the module connector 102. Since, in the normally closed state, opposite mating pins 606 are shorted to each other, one mating pin in a pair of mating pins 606 transmits the signals to the opposite mating pin in the pair of mating pins 606. The communication signal is then transmitted to the solder pins 608 acting as an output pin of the module connector 102. Therefore, the communication link remains intact even after removal of the I/O module 500 from the module connector 102.

The module connector 102 in absence of the I/O module 500 plugged into the slot 602 completes a communication link through the pair of mating pins 606. For example, a system may have an assembly of five module connectors 102 soldered to a circuit board 104 and only three of them have I/O modules 500 plugged into them. In such cases, communication between the I/O modules 500 and between the I/O module 500 and the CCB will be uninterrupted. Two module connectors 102 without I/O modules 500 complete the communication link through the pair of mating pins 606. Therefore, an uninterrupted communication is achieved even when the I/O modules 500 are not present in any or all the module connectors 102. Further, the module connector 102 eliminates the need for using dummy I/O modules.

In one implementation, one or more module connectors 102 may be present in a system independent of the backplane assembly 100 having and a supporting structure. For example, a module connector 102 may be coupled to a circuit board 104 without the circuit board 104 in turned being mounted on the supporting structure. As explained previously, the module connectors 102 may have a slot 602 with at least one pair of mating pins 606 that are normally closed pins which establish a communication link in absence of any I/O module 500 being plugged to the module connectors 102. Such a module connectors 102 may be employed in any system where uninterrupted communication link is required.

The module connector 102 may prove helpful in various industries where automated control and measurement operation is part of a system and an uninterrupted communication is required. Further, the module connector 102 is also cost effective. The module connector 102 reduces the overall cost of a system since dummy modules are not required for an uninterrupted communication. With the use of module connectors 102, the dummy module used for completing the communication link are no longer needed. For example, the module connectors 102 may be used in various systems and electronics products such as, data acquisition systems, industrial control systems, building automation and control systems, supervisory control and data acquisition (SCADA) systems, fire alarm systems, fire and gas detection/monitoring systems, safety shut-down systems, flow computer systems, hybrid controller systems, HVAC (heating, ventilation, and air conditioning) controllers, access controllers, flow controllers, and programmable logic controllers.

Although the subject matter has been described with reference to the specific embodiments, this description is not meant to be construed in limiting sense. Various modifications of the disclosed embodiments, as well as alternate embodiments of the subject matter, will become apparent to person skilled in the art upon reference to the description of the subject matter. It is therefore contemplated that such modifications can be made without departing from the spirit or the scope of the present subject matter as defined.

We claim:

1. A module connector for uninterrupted communication, the module connector comprising:

a slot for receiving at least one connector pin of an I/O module; and at least one pair of mating pins disposed in the slot, wherein the at least one pair of mating pins are normally closed, and wherein the at least one pair of mating pins moves to an open state upon receiving the at least one connector pin of the I/O module in the slot wherein the normally closed pair of mating pins complete a communication link through the module connector and the open state pair of mating pins establish a communication connection through the module connector and microprocessor of the I/O module through the at least one connector pin wherein a guiding rib on an external side surface of the module connector enables coupling of the at least one connector pin with a ground supply prior to the coupling of the at least one connector pin with a power supply.

2. The module connector as claimed in claim 1, wherein the slot comprises at least one groove, and wherein a pair of mating pins is disposed in the at least one groove.

3. The module connector as claimed in claim 1 further comprises a guiding rib on a side surface of the module connector, wherein the guiding rib enables coupling of the at least one connector pin with a ground supply prior to the coupling of the at least one connector pin with a power supply.

4. The module connector as claimed in claim 1, wherein the at least one pair of mating pins is made of a conductive and elastic material.

5. The module connector as claimed in claim 1, wherein the at least one pair of mating pins is coated with at least one of a conductive material, a corrosion resistant material and a temperature resistant material.

6. A system comprising:

a backplane assembly comprising, a circuit board; and one or more module connectors connected to the circuit board;

wherein each of the one or more module connectors comprises at least one pair of mating pins, and wherein the one or more module connectors are configured to establish a communication link through the at least one pair of mating pins in absence of an I/O module in the one or more module connectors wherein a guiding rib is formed on an external side surface of the one or more module connectors; and a supporting structure, wherein the supporting structure supports the backplane assembly wherein the pair of mating pins establish a communication connection through the module connector with a microprocessor of the I/O module in presence of the I/O module.

7. The system as claimed in claim 6, wherein the supporting structure is a DIN rail.

8. The system as claimed in claim 6, wherein the at least one pair of mating pins are normally closed pins.

9. The system as claimed in claim 6, wherein the at least one pair of mating pins is made of a conductive and elastic material.

10. The system as claimed in claim 6, wherein the system is one of a data acquisition system, an industrial control system, a programmable logic controller, a building automation and control system, a distributed control system, a supervisory control and data acquisition (SCADA) system, a fire alarm system, a fire and gas detection/monitoring system, an HVAC (heating, ventilation, and air conditioning) controller, an access controller, a flow controller, a safety shutdown system, and a hybrid controller system.

11. A system comprising:

at least one module connector, wherein the at least one module connector comprises:

a slot for receiving at least one connector pin of an I/O module; and at least one pair of mating pins disposed in the slot, wherein the at least one pair of mating pins is normally closed, and wherein at least one pair of mating pins moves to an open state upon receiving the at least one connector pin of the I/O module in the slot wherein the normally closed pair of mating pins complete a communication link through the at least one module connector and the open state pair of mating pins establish a communication connection through the module connector and microprocessor of the I/O module through the at least one connector pin wherein a guiding rib on an external side surface of the module connector enables coupling of the at least one connector pin with a ground supply prior to the coupling of the at least one connector pin with a power supply.

* * * * *